United States Patent [19]

Faul

[11] Patent Number: 4,869,540

[45] Date of Patent: Sep. 26, 1989

[54] PALLET PULLER APPARATUS

[76] Inventor: Joseph L. Faul, 1320 N. Avenue "G" , Crowley, La. 70526

[21] Appl. No.: 184,975

[22] Filed: Apr. 22, 1988

[51] Int. Cl.[4] ..... B66C 1/48

[52] U.S. Cl. ..... 294/116; 294/118

[58] Field of Search ..... 294/82.18, 82.32, 104, 294/106, 111, 112, 110.1, 116, 118, 119

[56] References Cited

U.S. PATENT DOCUMENTS

| | | | |
|---|---|---|---|
| 1,457,445 | 6/1923 | Marcum | 294/116 |
| 2,215,844 | 9/1940 | VanSyckle | 294/116 X |
| 3,807,786 | 4/1974 | Alegria | 294/104 |
| 3,923,333 | 12/1975 | Whaley | 294/104 |
| 4,098,533 | 7/1978 | Hanlon | 294/116 |
| 4,421,353 | 12/1983 | Smith | 294/116 X |

FOREIGN PATENT DOCUMENTS

| | | | |
|---|---|---|---|
| 56323 | 6/1939 | Denmark | 294/116 |
| 976947 | 3/1951 | France | 294/118 |
| 175801 | 3/1956 | Sweden | 294/118 |
| 903122 | 8/1962 | United Kingdom | 294/116 |
| 928282 | 6/1963 | United Kingdom | 294/118 |

*Primary Examiner*—Johnny D. Cherry

*Attorney, Agent, or Firm*—Pravel, Gambrell, Hewitt, Kimball & Krieger

[57] ABSTRACT

A pallet puller apparatus has a pair of jaws which are pivotally connected in a scissors-like fashion, with one of the jaws moving between a pair of body sections of the second jaw. On the first end of each jaw is a clamp portion having a plurality of teeth extending a predetermined distance beyond the interior wall of the jaw. The teeth grasp the pallet when the first ends of the jaws are moved toward each other. On the second end of each jaw is a force applicator which includes a mounting pin for the second end of a jaw in an arcuate slot built into the body portion of the force applicator. The second jaw has a pair of body sections through which the pin in the slot passes. When the force applicator is pulled, the second end of the second jaw travels in the slot, causing the jaws to come together. The more force that is used to pull on the force applicator, the stronger the jaws grip the pallet.

7 Claims, 2 Drawing Sheets

PALLET PULLER APPARATUS

BACKGROUND OF THE INVENTION

1. Field of the Invention

The apparatus of the present invention relates to pallets and the moving of pallets. More particularly, the present invention relates to an apparatus for engaging a center stringer of pallets so that force applied to the apparatus would pull the pallet in the direction of the force applied.

2. General Background

In the movement of pallets of the type having a plurality of board members nailed to the upper and lower sides of the stringers, when the pallet is loaded with cargo, the pallet must be lifted by means of, for example, fork lifts, in order to move the cargo from one location to another. However, oftentimes the pallet of cargo is placed in the confines of, for example, a truck or the like, and due to the confinement of space the pallet is unable to be moved through lifting, and therefore must be slid along the bed of the truck. Therefore, it is required that there be a means attachable to the pallet in order to slide the pallet along the bed of the truck, this attachment means being a very secure attachment point due to the excessive weight of a loaded pallet.

There are known in the art devices known as "Pallet Pulling Devices", which are utilized in the grasping and moving of loaded pallets. One particular device, described in U.S. Pat. No. 3,807,786 entitled "Pallet Puller", relates to a pallet puller apparatus having a first fixed jaw and a movable jaw which moves in opposition to the first jaw, each of the jaws secured to a center cross bar, with the hinge point of the movable jaw substantially in the center of the jaw. There is provided on the first end of the jaw a plate having a plurality of teeth, so that when a stringer or the like is placed between the jaws, and the movable jaw is moved relative to the stationary jaw, the stringer is grasped between the teeth, and is supposed to be pulled in the direction of the applied force. In order to move the movable jaw, there is provided on the second end of the jaws a spreader, which has a curved slot in it, with a pin which moves in the slot as the spreader is moved towards the force. The slot forces the second end of the movable jaw to move outward thus imparting inward, or opposite, movement in the direction of the teeth, toward the second, stationary jaw. When force is applied, the movable jaw is moved inward due to the pull of the spreader member.

There is a shortcoming to this particular device in view of the fact that (a) the jaw member, being a movable jaw, can only hinge to a point at the end of the curved slots, and therefore no force can be applied beyond a certain point; and (b) the teeth of the jaws extend a substantial length beyond the wall of the jaws, and therefore tend to engage the pallet to a point that may rip up the wood of the pallet, and therefore not to carry through its intended purpose.

SUMMARY OF THE PRESENT INVENTION

The apparatus of the present invention significantly improves the art of pallet pullers in the following manner. What is provided is a pallet puller apparatus having a pair of jaw members which are pivotally engaged along their center portion in a scissors-like fashion, with one of the jaw members moving between a pair of body sections of the second jaw member, so that each jaw member is pivoted along a central pin. On the first end of the jaw member is a clamp portion having a plurality of teeth extending a predetermined distance beyond the interior wall of the jaw members. The teeth grasp the pallet when the teeth are moved toward one another. On the second end of each jaw member is a force applicator which includes a mounting pin for the second end of a jaw member in an arcuate slot built into the body portion of the force applicator. The second jaw member has a pair of body sections through which the pin in the slot passes. When the force applicator is pulled, the second end of the second jaw member travels in the slot, causing the jaws to come together. The more force that is used to pull the force applicator, the stronger the jaw members grip the pallet.

Therefore, it is a principal object of the present invention to provide a pallet puller having the ability to increase the force applied to a pallet stringer as more force is applied to the force applicator of the pallet puller.

It is a further object of the present invention to provide a pallet puller wherein the teeth of the pallet puller can engage a stringer of pallets only to a certain depth so that the wood of the pallet is not damaged.

It is still a further object of the present invention to provide a pallet puller apparatus having a pair of jaw members which are pivotally mounted and movable between open and closed positions as force is applied or relieved, respectively.

It is still a further object of the present invention to provide a puller apparatus which can be utilized for engaging items such as steel drums, or any material that can be secured between a pair of opposing jaw members.

It is still a further object of the present invention to provide a puller apparatus which, when used in conjunction with a post member, may pull items such as stakes out of the ground in a quite simple fashion.

BRIEF DESCRIPTION OF THE DRAWINGS

For further understanding of the nature and objects of the present invention, reference should be had to the following detailed description, taken in conjunction with the accompanying drawings, in which like parts are given like reference numerals, and wherein:

FIG. 6 illustrates the apparatus of the present invention utilized in conjunction with a mounting post for retrieving stakes from the ground or the like.

DETAILED DESCRIPTION OF THE PREFERRED EMBODIMENT

Figure 4:
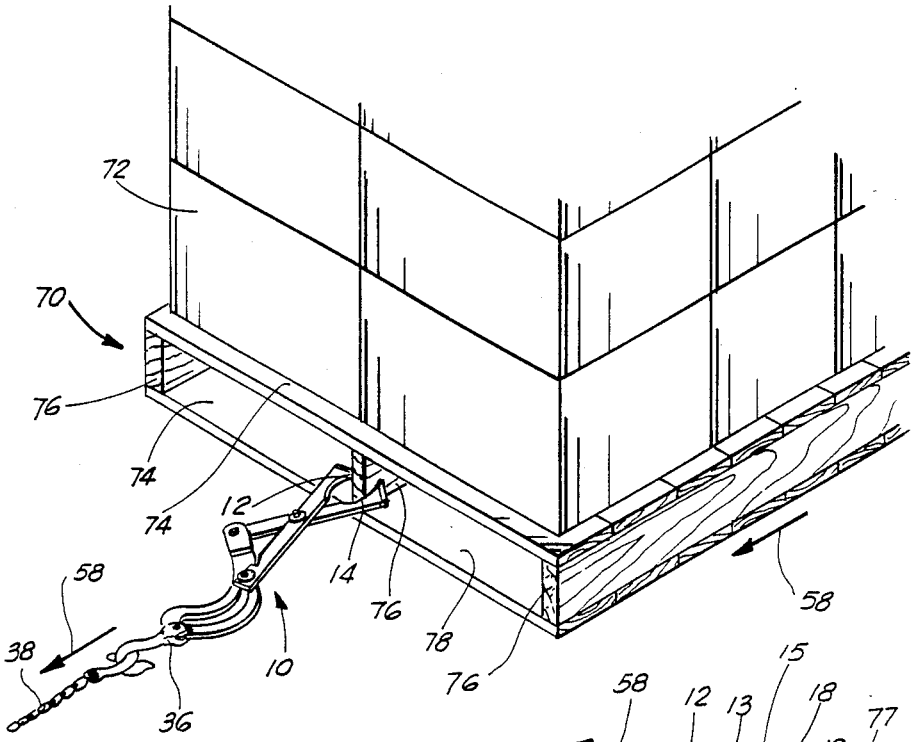
FIG. 4 shows the preferred embodiment of the apparatus of the present invention grasping a stringer of a pallet.
Figure 5:
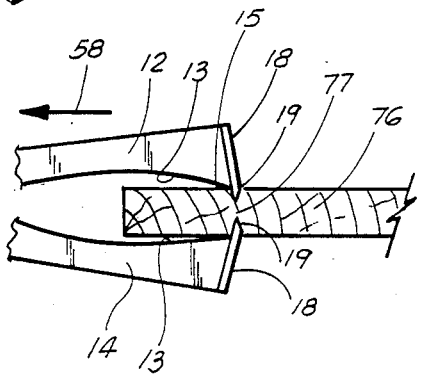
FIG. 5 is a detail showing the jaws engaging a stringer of a pallet.
Figure 6:
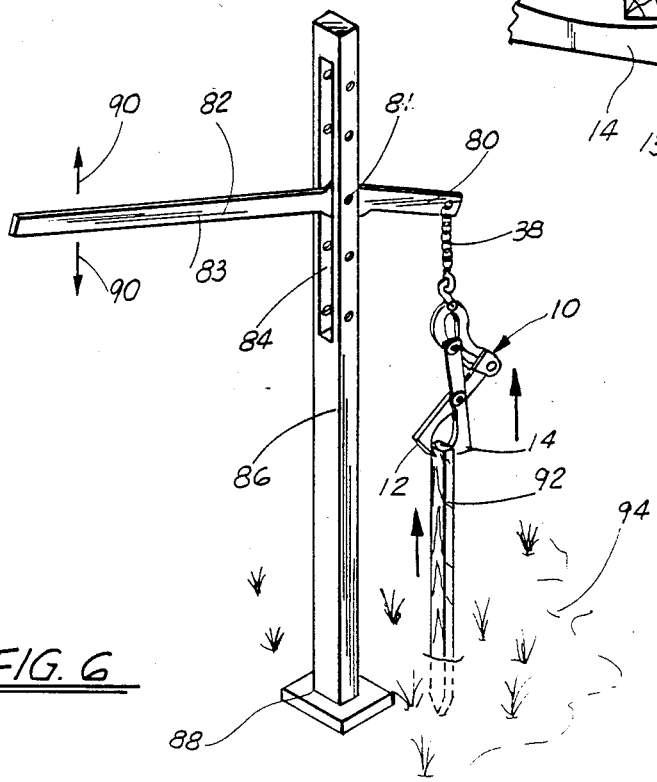

The preferred embodiment of the apparatus of the present invention is illustrated in FIGS. 1–5, with an alternative embodiment illustrated in FIG. 6. As seen in the Figures, pallet puller apparatus 10 includes a first jaw 12 and second jaw 14. Jaws 12 and 14 are pivotally connected with a pivot pin 16, so that the jaws 12 and 14 pivot in a scissors-like fashion about the centrally located pivot pin 16. Pin 16 has a head on one end and a cotter key adjacent the second end.

As illustrated, first jaw 12 would include an elongated body portion 13, the body portion 13 being of a solid length of metal, such as steel or the like. At the lowermost end of body portion 13, there is a clamping member 18 fixedly engaged through welding or the like to the end portion of body portion 13, with clamping member 18 having a plurality of teeth 19 extending out from the inner wall 20 of body portion 13 a predetermined distance as will be described further. Likewise, second jaw 14 includes an elongated body portion 15. However, body portion 15 includes a pair of body members 21 and 23, each of the body members running substantially parallel with an elongated slot 24 intermediate the body members 21 and 23 extending from the uppermost ends 25 of the body members 21 and 23 down to a point 26 substantially adjacent the lower end portion 27 of body portion 15. Slot 24 would be of a width to pivotally accommodate first jaw 12 as it pivots between open and closed positions as seen in the Figures. As was stated earlier, jaws 12 and 14 would be pivotally connected with a pin 16 to fix body portions 13 and 15 in movable relation as seen in the Figures. As with jaw 12, jaw 14 includes a clamping member 18 having a plurality of teeth 19 secured to clamping member 18 for engaging a pallet or the like as will be described further.

Figure 1:
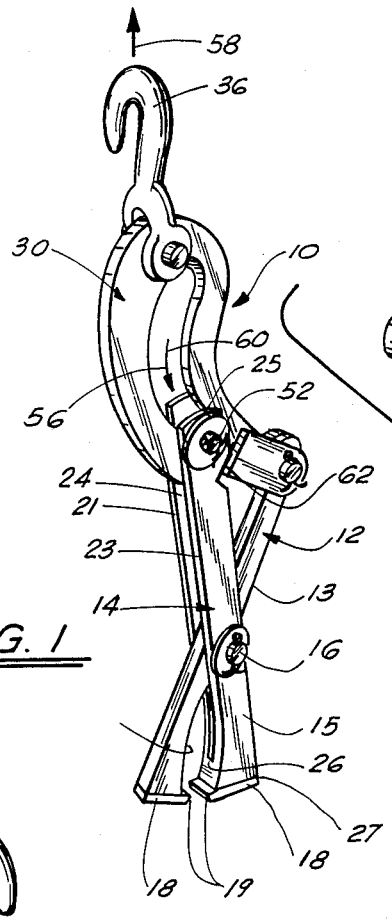
FIG. 1 is a perspective view of the preferred embodiment of the apparatus of the present invention with the jaws in a closed position.
Figure 3:
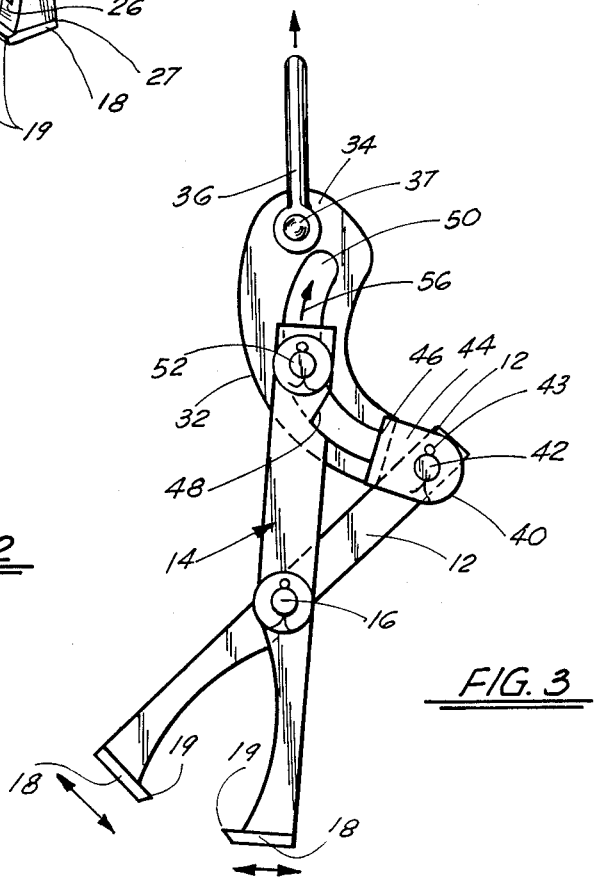
FIG. 3 is a side view of the present invention with the jaws in an open position.

Turning now to the second end of the opposing jaws 12 and 14, it is seen that both jaws are pivotally mounted to a force applicator 30, as seen particularly in FIGS. 1 and 3. Force applicator 30 includes an arcuate body portion 32 having an upper end portion 34. A mounting hook 36 is connected to means 30 with a pin 37. A chain 38 or the like (as seen in FIG. 4) is connected to hook 36 for applying force to the apparatus when in use. As seen in the Figures, body portion 32 further includes a lowermost end portion 40 which pivotally engages the upper end of jaw 12, via a pin 42 through the lower end portion 40 and jaw 12, with pin 42 secured with a cotter key 43 as seen in FIG. 3. Further, there is a plate member 44 which has a cam surface 46 for engaging a camming groove 48 in a second jaw 14, the purpose of which will be described further.

Figure 1A:
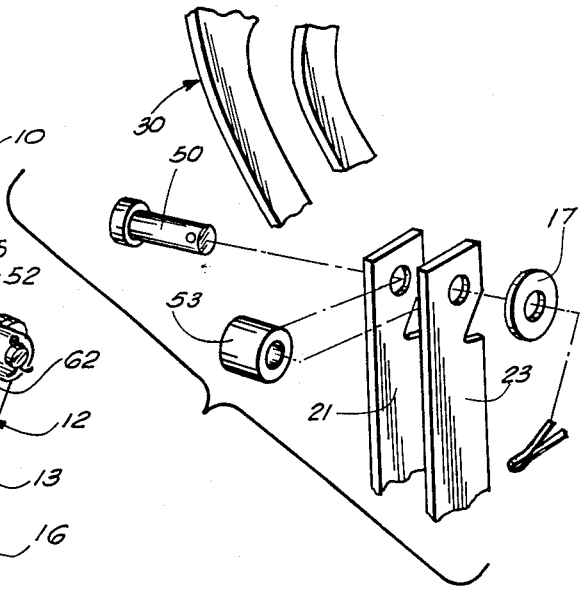
FIG. 1A is an exploded view of the traveling pin mechanism in the preferred embodiment of the present invention.

What is of particular significance in the present invention is the means by which the second jaw 14 is connected to the force applicator 30. As seen in FIG. 3, force applicator 30, being of arcuate shape, has a curved or arcuate central slot 50, the central slot 50 extending substantially from the upper end portion 34 of member 30 to the lower end portion 40 of force applicator 30, as seen in the Figures. Body members 21 and 23 are mounted on both sides of the faces of body portion 30, as seen in the Figures, with a mounting pin 52 engaged in slot 50 so that pin 52 serves as a traveling pin within slot 50 as the apparatus is moved between open and closed positions. FIG. 1A is an exploded view of pin 52 as it is rotatably attached to members 21 and 23. In order to facilitate the passage of pin 52 in arcuate slot 50, there is a free rotating housing 53 which makes contact along the inner edge 55 of arcuate slot 50, and therefore facilitates easy movement of the upper portion of the jaw 14 within arcuate slot 50 as described.

Figure 2:
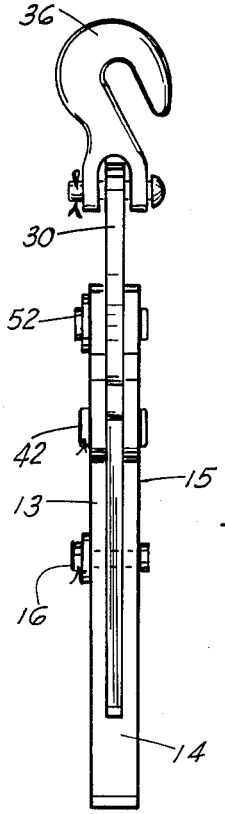
FIG. 2 is a side view of the apparatus of the present invention.

As seen in FIG. 2, jaws 12 and 14 operate in a scissors-like fashion; as the upper ends are spread apart, clamping members 18 are spread apart as seen in FIG. 3. Therefore, in order to impart spreading movement to clamping members 18, mounting pin 52 must travel within slot 50 in the direction of Arrow 56 so that clamping members 18 move to the open position as seen in FIG. 3. Likewise, as seen in FIG. 1, when force is applied to hook 36 in the direction of Arrow 58, mounting pin 52 must travel downward in the direction of Arrow 60, as seen in FIG. 1, and in doing so, due to the arcuate movement of the mounting pin 52 in the direction of pin 42 of jaw 12, the jaws 12 and 14 are moved to the closed position as seen in FIG. 1, which imparts inner movement to clamping members 18 as seen in FIG. 1.

Due to the curvature of arcuate slot 50, and the traveling of pin 52 within slot 50 as more force is applied to hook 36 in the direction of Arrow 58, the pin 52 tends to travel further down into the lower region of slot 50, and therefore likewise tends to apply more and more inward force between clamping members 18, thus resulting in a tightening of the clamping members 18 onto an item such as a stringer 76 (FIG. 5). Therefore, the inner clamping forces of the jaws 12 and 14 increase as more force is applied in order to pull a pallet 70 or the like in the direction of Arrow 58.

However, in order to possibly prevent jaws 12 and 14 from applying unnecessary force, plate members are mounted at the end portion 40 of body portion 32. Camming surfaces 46 of members 44 engages camming groves 48 in the body members 21 and 23. Plate members 44 and groove 48 serve as a stop as seen in FIG. 1, so that no further clamping force is applied as more force is applied in the direction of Arrow 58.

Turning now to FIGS. 4 and 5, there is illustrated a pallet 70 having a load of cargo 72, with the pallet 70 having upper and lower boards 74 with a plurality of stringers 76 to provide a lifting space 78 between the upper and lower boards 74. Jaws 12 and 14 are clamped on the central stringer 76 as a chain 38 attached to hook 36 applies force in the direction of Arrow 58. In FIG. 5, teeth 19 are seen engaging the wood of stringer 76 as force is applied in the direction of Arrow 58. That would eventually cause pallet 70 to slide in that same direction. Teeth 19 do not literally "bite" through the central stringer 76; a portion of wood 77 is maitained intact between the teeth 19 biting into the central stringer 76. This is because teeth 19 extend out a limited distance from the inner walls 113 of first and second jaws 12 and 14 respectively, so that the inner walls 13 serve as stop means which engage the central stringer 76 so that teeth 19 do not bite into the wood but to said limited distance. Therefore, the integrity of the pallet stringer 76 is preserved.

FIG. 6 illustrates an additional use of apparatus 10. As seen in FIG. 6, apparatus 10 is hanging from a chain 38 extending from the puller portion 80 of a lever 82. Lever 82 is mounted in a groove 84 of a post 86 having a base 88. The lever 82 is pivotally mounted on a pin 81 which allows lever handle 83 to move upward and downward in the direction of Arrows 90. Also shown in FIG. 6 is a stake 92 in the ground 94. The stake 92 must be pulled up in order to be removed. As seen in FIG. 6, post 86 is placed adjacent pulling portion 80 of stake 92, lever 82 is lowered so that the jaws 12 and 14 engage the stake 92, and as downward force is put on the handle 83 of lever 82 in the direction of the lower Arrow 90, stake 92 is lifted upward and easily removed from the ground. This type of use of the apparatus 10 would be applicable in, for example, the removal of stakes after a slab or foundation has been formed, and the wood form has to be removed. This would facilitate quick and easy removal of the form. Likewise, or course, this particular embodiment could be used to pull any item from a floor, wall, or ground, when in fact upward force is needed to pull the item from a secure fixed position.

Apparatus 10 can be used to lift loaded metal drums. For example, teeth 19 would engage the inner and outer walls of the drum, and as force is applied upward, the teeth 19 would bite into the metal drum and lift the drum and move it into position for further use. It is seen that the particular novelty having to do with the applied force from the pulling on the curved force applicator 30 is the force that enables the pallet puller to have an unusual ability to pull on an item in view of the fact that as more pulling force is applied, more biting force in turn results between the teeth 19.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. A puller apparatus, comprising:

(a) a first jaw member having a solid body portion and having a plurality of teeth secured to a first lower end of the body portion;

(b) a second jaw member, having a body portion, the body portion including an elongated slot along a portion of its length dividing the body portion into a pair of wall portions, the jaw member likewise having a plurality of teeth on a lower end thereof;

(c) means for pivotally attaching the first jaw member to the second jaw member, substantially midway along their length, the first jaw member positioned in the slot of the second jaw member, and the teeth of the first and second jaw members movable between open and closed positions in opposition to one another; and (d) force applicator means, comprising a body member having a lower portion pivotally secured to an upper end of the first jaw member, the body member partially positioned in the slot of the second jaw member and including a traveling slot in the body member, for accommodating a traveling pin extending between the pair of wall portions of the upper portion of the second jaw member, so that as force is applied in the direction upward on the force applicator means the traveling pin travels through the traveling slot and imparts movement of the second jaw member to the closed position relative to the first jaw member.

2. The apparatus in claim 1, wherein the body portion of the first jaw member is substantially an elongated structure.

3. The apparatus in claim 1, wherein the slot in the body portion of the second jaw member extends through the body portion from the upper end to a point adjacent the lower end.

4. The apparatus in claim 1, wherein the force applicator means further includes a hook member on an upper portion of the body member of the force applicator means so that upward pull of the hook member imparts the traveling motion of the pin in the traveling slot downward to effect closure of the jaw members during use.

5. A pallet puller apparatus, comprising:

(a) a first jaw member, comprising an elongated body portion, having a plurality of teeth at its first lower end, and a slot extending from an upper end of the body portion along the length of the body portion to a point substantially adjacent the plurality of teeth, the slot dividing the body portion into a pair of parallel side walls;

(b) a second jaw member, comprising an elongated body portion, including a plurality of teeth on a first lower end, the body portion of the second jaw member positioned within the slot of the body portion of the first jaw member, and pivotally engaged thereto so that the teeth of the first and second jaw members are movable between open and closed positions in relation to one another;

(c) means for pivotally attaching the first jaw member to the second jaw member, substantially midway along their length, the second jaw member positioned in the slot of the first jaw member, and the teeth of the first and second jaw members movable between open and closed positions in opposition to one another;

(d) a force applicator, further comprising an arcuate shaped body member having a lower portion pivotally secured to the upper end of the second jaw member, the arcuate-shaped body member pivotally partially positioned in the slot of the first jaw member and including a traveling slot in the body member for accommodating a traveling pin extending between the pair of parallel side walls of the body portion of the first jaw member, so that as force is applied in the direction upward on the force applicator, the traveling pin travels through the traveling slot and imparts movement of the first jaw member to the closed position relative to the second jaw member, so that as additional force is applied in the upper direction, the teeth of the jaw members are maintained in the closed position with increased force.

6. The apparatus in claim 5, wherein there is further provided means for restricting the travel distance of the pin through the arcuate slot, so that the jaw members may close only to a certain point.

7. A pallet puller apparatus, comprising:

(a) a first jaw member, comprising an elongated body portion, having a plurality of teeth at its first lower end, and a slot extending from an upper end of the body portion along the length of the body portion to a point substantially adjacent the plurality of teeth, the slot dividing the body portion into a pair of parallel side walls;

(b) a second jaw member, comprising an elongated body portion, including a plurality of teeth on a first lower end, the body portion of the second jaw member positioned within the slot of the body portion of the first jaw member, and pivotally engaged thereto so that the teeth of the body of the first and second jaw members are movable between open and closed positions in relation to one another;

(c) means for pivotally attaching the first jaw member to the second jaw member, substantially midway along their length, the second jaw member positioned in the slot of the first jaw member, and the teeth of the first and second jaw members movable between open and closed positions in opposition to one another;

(d) a force applicator comprising an arcuate shaped body member having a lower portion pivotally secured to the upper end of the second jaw member, the arcuate shaped body member partially positioned in the slot of the first jaw member and including a traveling slot in the body member for accommodating a traveling pin extending between the pair of parallel side walls of the body portion of the first jaw member, so that as force is applied in the direction upward on the force applicator, the traveling pin travels through the traveling slot and imparts movement of the first jaw member to the closed position relative to the second jaw member, so that the additional force is applied in the upper direction, the teeth of the jaw members are maintained in the closed position.

* * * * *